United States Patent [19]

Umezawa et al.

[11] 4,397,340

[45] Aug. 9, 1983

[54] WEFT DETAINING DEVICE FOR SHUTTLELESS LOOM

[75] Inventors: Hidetsugu Umezawa, Higashiyamato; Takashi Ogasawara, Tokyo; Takao Honya, Koganei, all of Japan

[73] Assignee: Nissan Motor Co., Ltd., Yokohama, Japan

[21] Appl. No.: 315,516

[22] Filed: Oct. 27, 1981

[30] Foreign Application Priority Data

Nov. 12, 1980 [JP] Japan ..... 55-158137

[51] Int. Cl.[3] ..... D03D 47/36

[52] U.S. Cl. ..... 139/452; 242/47.01

[58] Field of Search ..... 139/435, 452; 242/47.01, 47.04, 47.05, 47.12

[56] References Cited

FOREIGN PATENT DOCUMENTS 22112 1/1981 European Pat. Off. ..... 139/452
24561 3/1981 European Pat. Off. .
43092 1/1982 European Pat. Off. .
2039716 11/1969 Fed. Rep. of Germany .
1478294 4/1967 France .
1547158 11/1968 France .

*Primary Examiner*—Henry Jaudon
*Attorney, Agent, or Firm*—Thompson, Birch, Gauthier & Samuels

[57] ABSTRACT

A weft detaining device of a shuttleless loom, including a drum having a frustoconical section and a cylindrical section, a first catching member for catching the weft yarn on the drum in the vicinity of the border between the frustoconical and cylindrical sections for at least a period of weft pickings, a second catching member for catching the weft yarn on the drum for at least a period of the first time weft picking in sequential twice weft pickings and releasing its catching action to the weft yarn for at least a period of the second time weft picking of the sequential twice weft pickings, and a third catching member for catching the weft yarn on the drum cylindrical section for at least a period wherein the detaining of the weft yarn for the succeeding twice sequential weft pickings is completed, thereby enabling a so-called dual-pick pass weft insertion though the weft detaining device is of the drum type.

18 Claims, 18 Drawing Figures

WEFT DETAINING DEVICE FOR SHUTTLELESS LOOM

BACKGROUND OF THE INVENTION

This invention relates to a drum-type weft detaining device of a shuttleless loom, enabling a so-called dual-pick pass weft insertion wherein, after twice sequential weft pickings by a weft inserting device, no weft picking takes place for a time period at which sequential twice weft pickings take place by another weft inserting device.

In connection with shuttleless looms, it has been proposed to employ a drum type weft detaining device wherein a weft yarn of a predetermined length is detained or stored on a drum prior to weft picking through a weft inserting device. The drum is stationary or rotatable in timed relation to the operational cycle of the loom However, such drum type weft detaining devices have not enabled a so-called dual-pick pass weft insertion. In the dual-pick pass weft insertion, two weft yarns are alternately inserted, with sequential twice pickings, into a warp shed respectively from two weft inserting devices, in which it is necessary to detain one weft yarn in the length required for twice weft pickings during the twice sequential weft pickings of another weft yarn. Furthermore, it is necessary to catch the detained weft yarn at its central section to prevent the weft yarn length for the subsequent picking from being drawn-off during the former picking. The thus complicated manner for weft detaining has not been able to be achieved by the conventional drum type weft detaining device.

BRIEF SUMMARY OF THE INVENTION

According to the present invention, in a shuttleless loom of the type enabling a so-called dual-pick pass weft insertion, the weft detaining device comprises a drum on which a weft yarn is wound prior to its introduction to a weft inserting means, which drum is formed with a frustoconical section tapered toward the weft inserting means side, and a cylindrical section connected to said frustoconical section. A first catching member is provided to catch the weft yarn on the drum in the vicinity of the border between the frustoconical and cylindrical sections for at least a period of weft pickings, in timed relation to the operational cycle of the loom. A second catching member is provided to catch the weft yarn on the drum for at least a period of the first time weft picking in sequential twice weft pickings and to release its catching action to the weft yarn for at least a period of the second time weft picking in sequential twice weft pickings, in timed relation to the loom operational cycle. Additionally, a third catching member is provided to catch the weft yarn on the drum cylindrical section for at least a period during which the detaining of the weft yarn required for the succeeding twice weft pickings is completed. The thus arranged weft detaining device enables so-called dual-pick pass weft insertion, ensuring twice sequential weft pickings with accurately measured weft lengths, though the weft detaining device is of the drum type.

BRIEF DESCRIPTION OF THE DRAWINGS

The features and advantages of the shuttleless loom weft detaining device according to the present invention will be clearly appreciated from the following description taken in conjunction with the accompanying drawings in which like reference numerals and characters designate the corresponding parts and elements thoughout all the embodiments, in which.

DETAILED DESCRIPTION OF THE INVENTION

Figure 1:
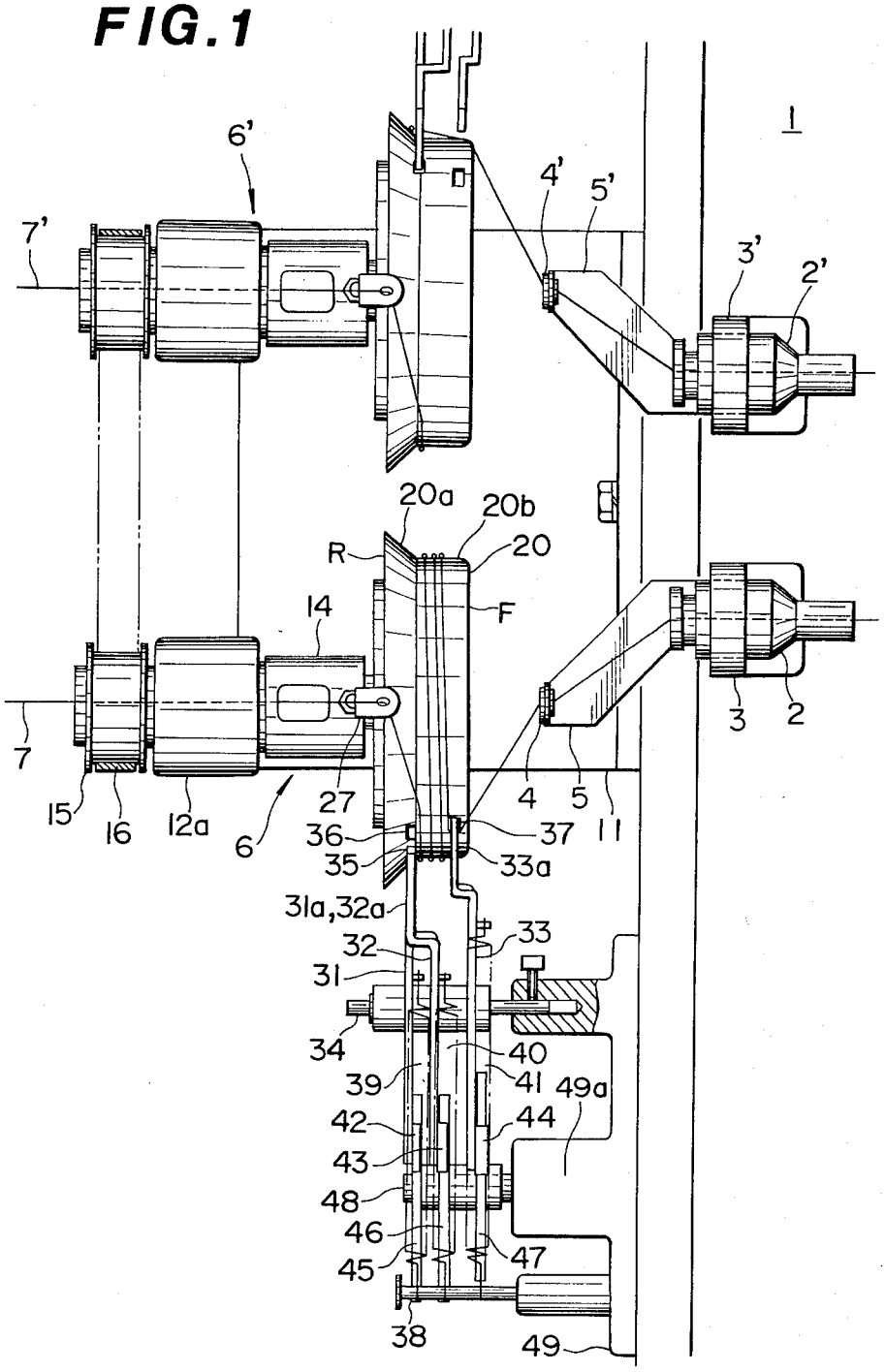
FIG. 1 is a top plan view of an essential part of a shuttleless loom which is equipped with a pair of weft detaining devices each being an embodiment in accordance with the present invention.

Referring now to FIGS. 1 to 10 of the drawings, there is shown a water-jet shuttleless loom equipped with two weft detaining devices each of which is an embodiment according to present invention, in which the weft detaining device is of the stationary drum type. The shuttleless loom consists of two weft inserting water injection nozzles 2, 2' which are supported respectively by two nozzle holders 3, 3' which are in turn fixed on a frame 1 of the shuttleless loom. Two weft guides 4, 4' are supported respectively by two stays 5, 5' which are secured respectively to the nozzle holders 3, 3' which are respectively located rearward of the nozzles 2, 2'. Accordingly, two weft yarns 7, 7' from the weft detaining devices 6, 6' discussed hereinafter are introduced respectively into the nozzles 2, 2' through the weft guides 4, 4' and then picked or inserted into a warp shed (not shown) by means of water-jets ejected from the nozzles 2, 2'. The reference numerals 8, 8' designate bobbins as weft supply means or sources, respectively.

Figure 2:
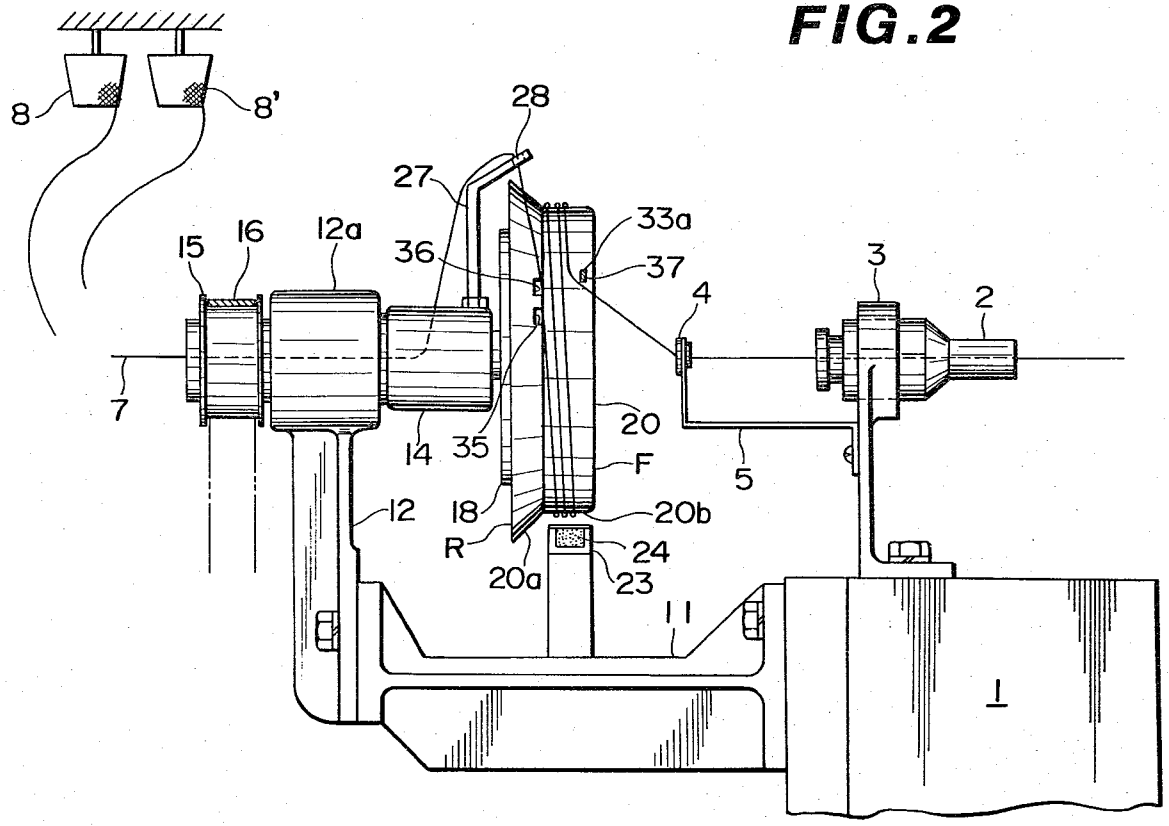
FIG. 2 is a front elevation of one of the weft detaining devices of FIG. 1.

The two weft detaining devices 6, 6' are the same in construction and function, and therefore the explanation will be made hereinafter only on the weft detaining device 6. A bracket 12 having a bearing section **12*a* is secured to the frame 1 of the shuttleless loom through a horizontally disposed bracket 11 which is directly secured to the frame of the loom by bolts, as shown in FIG. 2. The bracket 12 is connected at its bottom part to the bracket 11 with bolts and nuts so that the axis of the bearing section 12*a* is in alignment with that of the weft guide 4**.

Figure 3:
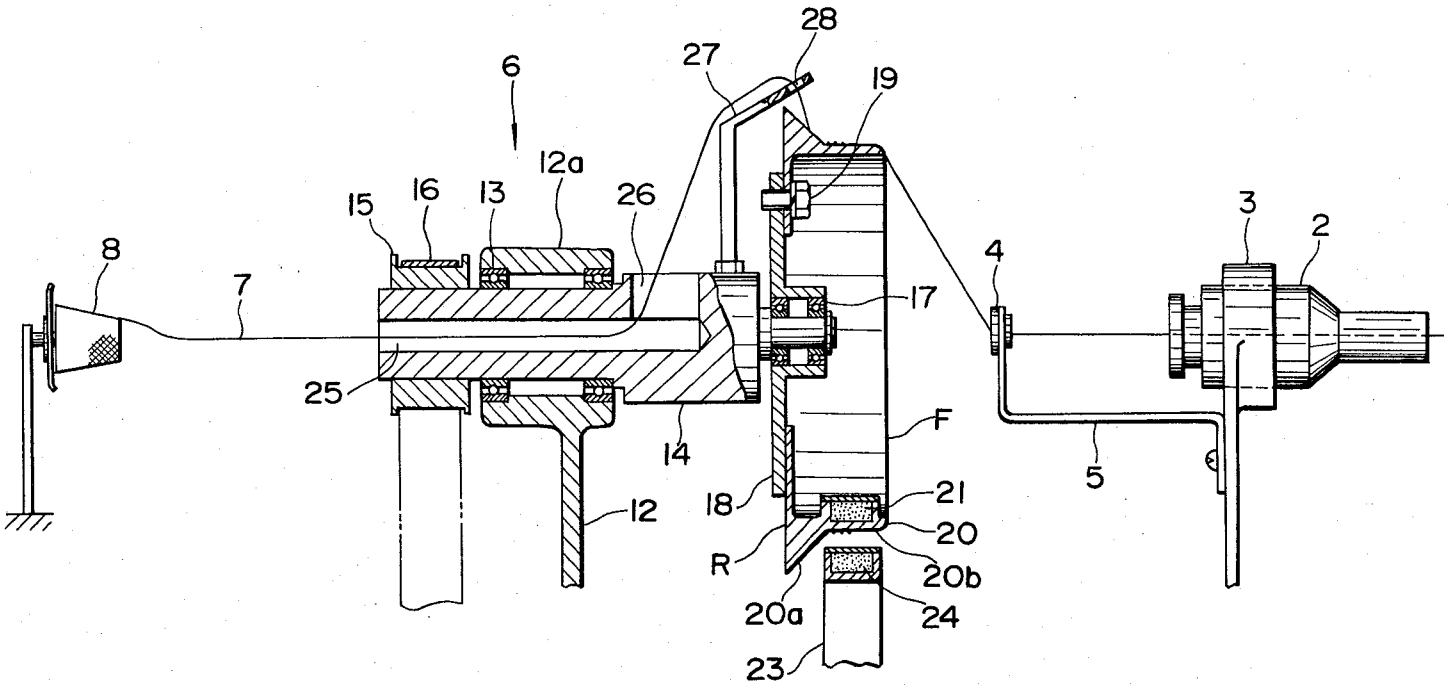
FIG. 3 is a view showing the vertical section of the weft detaining device of FIG. 2.
Figure 4:
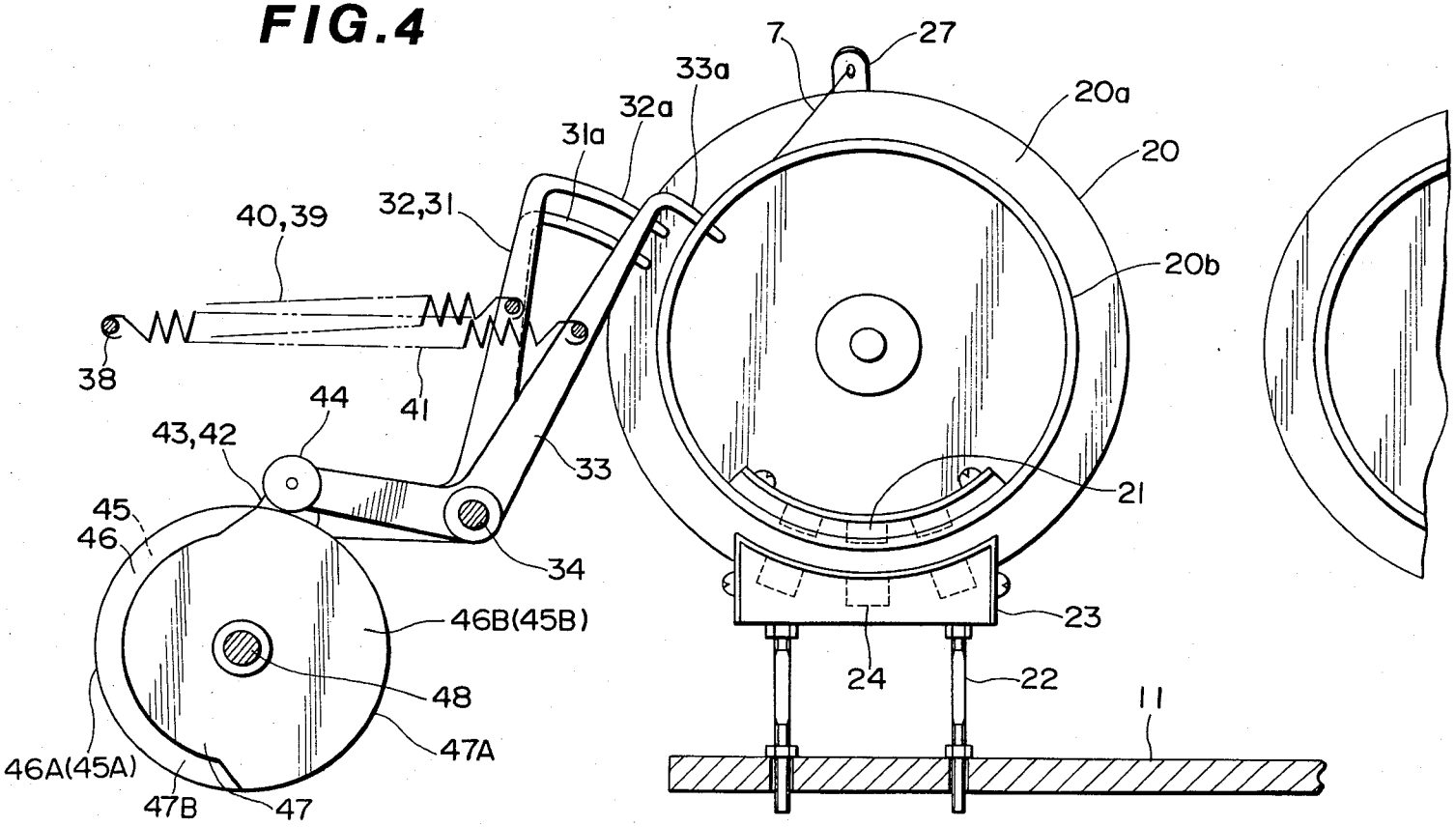
FIG. 4 is a side elevation of an essential part of the weft detaining device of FIG. 2.

As clearly shown in FIG. 3, a shaft 14 is rotatably supported at its central section within the bearing section 12*a* through a ball bearing 13. A toothed pulley 15 is fixedly mounted on a rear section of the rotatable shaft 14. A toothed belt 16 is provided to connect the pulley 15 and a drive pulley (not shown) to rotate the rotatable shaft 14 in accordance with the operation of the loom. In this case, the transmission ratio or the ratio between the rotation of the rotatable shaft 14 and the operational cycle of the loom is 2:1 in which the rotatable shaft 14 rotates two times per each operational cycle of the loom.

A support member 18 is rotatably mounted through ball bearings 17 on a front section of the rotatable shaft 14 so as to be rotatable relative to the shaft 14. A drum 20 forming part of the weft detaining device 6 is fixedly supported by the support member 18 by means of bolts 19. The drum 20 is formed with an outer peripheral surface which comprises a frustoconical section 20*a* connecting to the rear end R of the drum and whose diameter gradually decreases in the direction of the weft inserting nozzle 2, i.e. from the rear end R toward the front end F of the drum 20. The drum outer peripheral surface further comprises a cylindrical section 20*b* which integrally connects with the frustoconical section 20*a* and extends to the front end F of the drum 20. The diameter of the cylindrical section 20*b* is so set that the length of the weft yarn 7 wound about four times around the cylindrical section 20*b* corresponds to the weft yarn length requires for each pick. The cylindrical section 20*b* may be slightly tapered toward the front end F of the drum 20. Magnets 21 are securely attached on a part of the inside surface of the drum 20, which magnets are positioned opposite to magnets 24 which are located outside of and spaced from the drum 20. The magnets 24 are secured to a support 23 which is firmly connected to the bracket 11 through stud bolts 22 which are mounted to the bracket 11. As a result, the drum 20 is maintained at the stationary state regardless of the rotation of the rotatable shaft 14, under the action of the magnetic attraction generated between the magnets 21 and 24.

The rotatable shaft 14 is formed along its axis with an elongate weft introduction hole 25 which opens to the rear end face of the rotatable shaft 14. Additionally, a drawing-off opening 26 is formed at the outer surface of the shaft 14 so as to communicate with the weft introduction hole 25. Securely attached on the rotatable shaft peripheral surface forward of the opening 26 is a weft winding guide member 27 which is formed at its top section with a guide opening 28 through which the weft yarn 7 is guided onto the frustoconical section 20*a* of the drum 20. The weft winding guide member 27 is bent to approach the surface of the frustoconical section 20*a*. Accordingly, the weft yarn 7 drawn from the weft supply source 8 is introduced into the weft introduction hole 25 and then into the drawing-off opening 26. Subsequently, after being introduced along the winding guide member 27 and passed through the opening 28, the weft yarn 7 is wound around the frustoconical section 20*a* and the cylindrical section 20*b*, in which the weft yarn 7 is caught by at least one of first, second and third hook levers 31, 32 and 33 which will be discussed hereinafter. Thereafter, the weft yarn 7 will be passed through the weft guide 4.

As shown, the hook levers 31, 32 and 33 are pivotally and rotatably mounted on a fixed shaft 34 and formed at their end sections with first, second and third hook sections 31*a*, 32*a* and 33*a*, respectively. The hook sections 31*a*, 32*a* and 33*a* are located to be able to be inserted respectively into through-holes 35, 36 and 37. The holes 35, 36 are located in the vicinity of the border between the frustoconical section 20*a* and the cylindrical section 20*b*. The holes 35, 36 are slightly spaced from each other in the direction of the periphery of the drum 20. The hole 37 is located on the cylindrical section 20*b*. In this instance, the holes 35, 36, 37 pass through or pierce the wall of the drum 20. The first, second and third hook levers 31, 32, 33 are further provided at the other ends thereof with cam rollers or followers 42, 43 and 44, respectively. The hook levers 31, 32, 33 are biased counterclockwise in FIG. 4 by means of springs 39, 40 and 41, respectively, each spring being disposed between a stationary pin 38 and a pin (no numeral) mounted on each hook lever, so that the cam rollers 42, 43, 44 are always in contact with rotatable cams 45, 46 and 47, respectively. The cam 45, 46, 47 are securely mounted on a rotatable shaft 48 which rotates ¼ times per each operational cycle of the loom. The rotatable shaft 48 is rotatably supported by a bearing section 49*a* forming part of a base 49 by which the fixed shaft 34 and the stationary pin 38 are firmly supported, as shown in FIG. 1. The cams 45, 46, 47 are formed respectively with high lobe sections 45A, 46A and 47A, and low lobe section 45B, 46B and 47B. With this arrangement, when the high lobe section 45A, 46A, or 47A of the cam 45, 46, or 47 contacts the cam roller 42, 43, or 44, the hook lever 31, 32, or 33 rotates clockwise in FIG. 4. As a result, the hook section 31*a*, 32*a*, or 33*a* enters or is inserted into the hole 35, 36, or 37 of the drum 20. On the contrary, when the low lobe section 45B, 46B, or 47B of the cam 45, 46, or 47 contacts the cam roller 42, 43, or 44, the hook section 31*a*, 32*a*, or 33*a* is withdrawn from the drum hole 35, 36, or 37. It is preferable that each hook section 31*a* and 32*a* of the first and second hook levers 31, 32 is formed at its tip portion with a tapered or inclined surface which is generally parallel to the tapered surface of the drum frustoconical section 20*a*, in order that the weft yarn 7 can well be separated when the hook section enters or is inserted into the hole of the drum.

Figure 5:
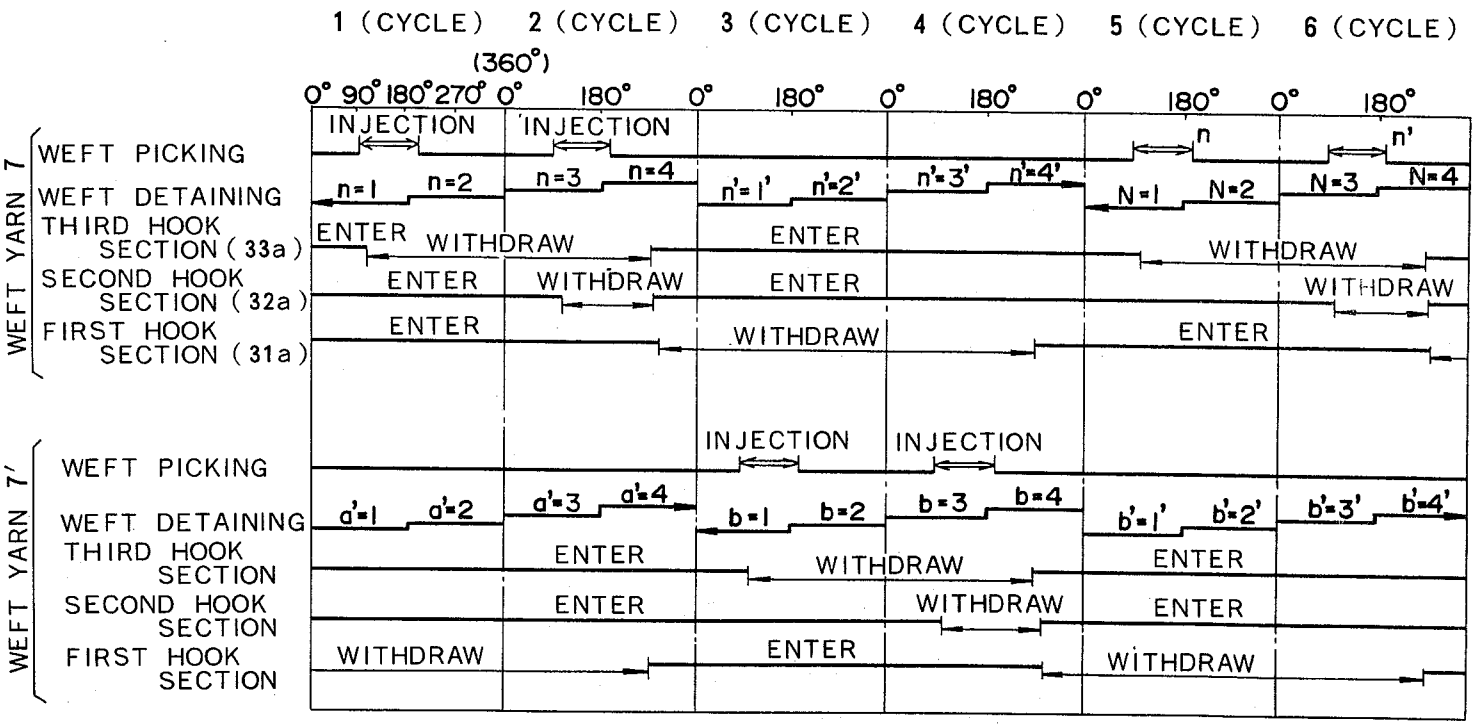
FIG. 5 is a timing chart of the operation of the shuttleless loom of FIG. 1.

The manner of operation of the weft detaining device will be discussed hereinafter with reference to FIGS. 5 to 10. In FIG. 5, "1 to 6 (CYCLES)" designates 1st to 6th operational cycles of the loom. "0°, 90°, 180°, 270°, and 360°" designate the operational timings or angles within each loom operational cycle, in which "0° (=360°)" is the timing of beating up by a reed (not shown). "INJECTION" in terms of "WEFT PICKING" designates a water-jet ejection from the nozzle 2 as a weft inserting means. The numerals "1 to 4" in terms of "DETAINING" designate the number of winding times of the weft yarn wound around the drum. "ENTER" and "WITHDRAW" in terms of "FIRST, SECOND and THIRD HOOK SECTIONS (33*a*, 33*b*, 33*c*)" designate the state where the hook section of the hook lever enters or is inserted into the hole of the drum, and the state where the hook section is withdrawn from the hole of the drum, respectively.

During the operation of the loom, the rotatable shaft 14 rotates two times per each loom operational cycle; however the drum 20 cannot rotate and is maintained at the stationary state by virtue of the magnetic attraction generated between the magnet 21 attached to the drum 20 and the stationary magnet 24. Accordingly, with the rotation of the rotatable shaft 14, the weft winding guide member 27 rotates around the periphery of the drum 20, so that the weft yarn 7 is wound around the frustoconical section 20*a* of the drum 20. Then, the weft yarn 7 of the frustoconical section 20*a* slides along the slope of the frustoconical section 20*a* by its own tension and moves to the cylindrical section 20*b*, pushing ahead the wound weft yarn located forward thereof.

When the loom operational cycle reaches a timing immediately before the first time weft picking in the 1st loom operational cycle (1st CYCLE in FIG. 5), the hook sections 31*a*, 32*a*, 33*a* of the first, second, third hook levers 31, 32, 33 enter or are inserted into the holes 35, 36, 37 of the drum 20, respectively. In this state, the weft yarn 7 is caught by the first hook section 31*a* and is then caught by the second hook section 32*a* after being wound four times around the drum 20 in the vicinity of the border between the frustoconical and cylindrical sections 20*a*, 20*b*; the weft yarn 7 is further caught by the third hook section 33*a* after being wound four times around the drum cylindrical section 20*b*.

At the first time weft picking, the third hook section 33*a* is withdrawn from the hole 37 of the drum 20, so that the weft yarn 7 wound between the second and third hook sections 32*a*, 33*a* is drawn off to be picked into the warp shed under the influence of water-jet ejection through the nozzle 2 which ejection begins immediately before this withdrawal of the third hook section. When the amount of the weft yarn wound between the second and third hook sections 32*a*, 33*a* becomes zero or nothing by the weft picking, the weft yarn 7 is caught by the second hook section 32*a* to complete the weft picking. Until the completion of this weft picking, the weft yarn 7 is wound about two times on the drum at the frustoconical section (20*a*) side relative to the first hook section 31*a* by the rotation of the weft winding guide member 27 (See FIG. 6 which is at 270° in 1st loom operational cycle).

At the second time weft picking in the 2nd loom operational cycle, the second hook section 32*a* is withdrawn from the hole 36 of the drum 20, so that the weft yarn 7 wound between the first and second hook sections 31*a*, 32*a* is drawn off to be picked or inserted into the warp shed, under the influence of water-jet ejection through the nozzle 2 which ejection begins immediately before the withdrawal of the second hook section 32*a*. When the amount of the weft yarn 7 wound between the first and second hook sections 31*a*, 32*a* becomes zero or nothing by this weft picking, the weft yarn 7 is caught by the first hook section 31*a* to complete the weft picking. Until this time, the weft yarn 7 is wound about four times on the drum 20 at the frustoconical section (20*a*) side relative to the first hook section 31*a* by the rotation of the weft winding guide member 27 (See FIG. 7 which is at 230° in the 2nd loom operational cycle).

Figure 8:
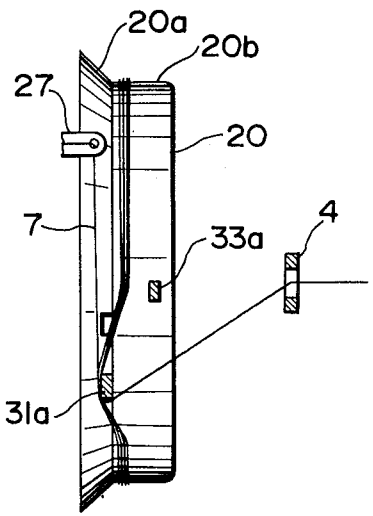
FIGS. 6 to 10 are side views of a drum of the weft detaining device of FIG. 2 at various operational timings, illustrating the operation of the weft detaining device.
Figure 7:
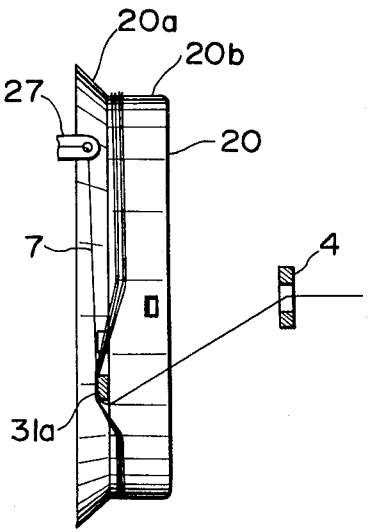
Figure 6:
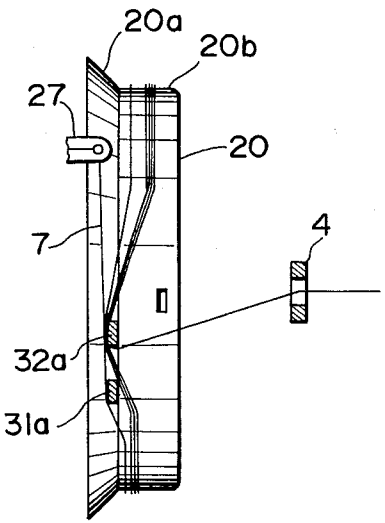

Thereafter first the third hook section 33*a* is again inserted into the hole 37 of the drum 20 (See FIG. 8 which is at 270° in the 2nd loom operational cycle). Subsequently, the first hook section 31*a* is withdrawn from the hole 35 of the drum 20, so that the weft yarn 7 which has been wound about four times around the frustoconical section 20*a* slides down along the slope of the frustoconical section 20*a* and moves onto the cylindrical section 20*b*, and is caught by the third hook section 33*a*. Almost simultaneously with the withdrawal of the first hook section 31*a*, the second hook section 32*a* is inserted into the hole 36 of the drum 20 to detain the weft yarn 7 wound four times between the second hook section 32*a* and the third hook section 33*a* (See FIG. 9 which is at 315° in the 2nd loom operational cycle). Accordingly, the weft yarn 7 to be supplied hereinafter by the weft winding guide member 27 is wound around the drum 20 at the frustoconical section (20*a*) side relative to the second hook section 32*a*.

In the 3rd and 4th loom operational cycles, the weft yarn 7' detained by another weft detaining device 6' is inserted into the warp shed through the weft inserting nozzle 2', in which sequential twice weft pickings take place as shown in FIG. 5. In the weft detaining device 6, the weft yarn 7 is wound about four times on the drum 20 at the frustoconical section (20*a*) side relative to the second hook section 32*a* until the weft picking in the 4th loom operational cycle is completed.

Figure 10:
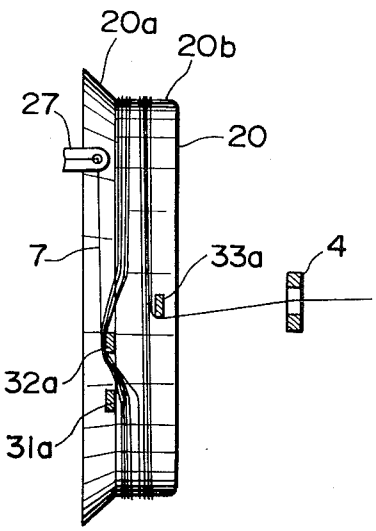
Figure 9:
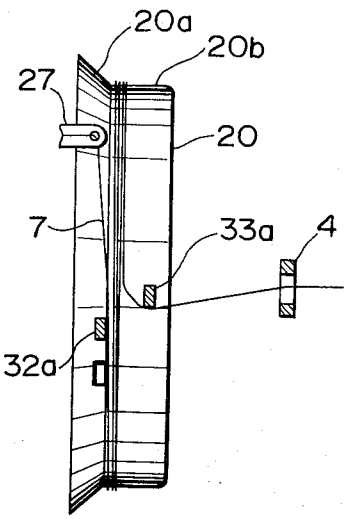
Figure 11:
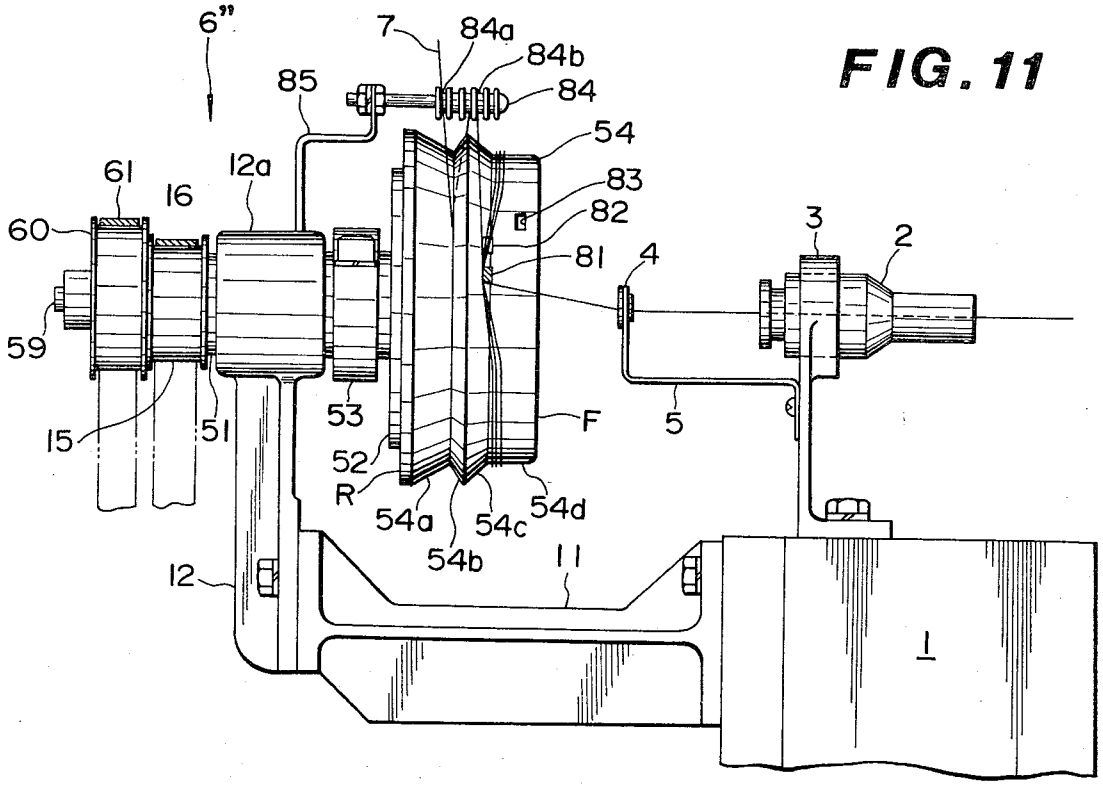
FIG. 11 is a front elevation of an essential part of the shuttleless loom equipped with another embodiment of the weft detaining device in accordance with the present invention.

Then, the first hook section 31*a* is inserted into the hole 35 of the drum 20 to detain the weft yarn 7 wound four times between it and the second hook section 32*a* (See FIG. 10 which is at 275° in the 4th loom operational cycle). Accordingly, the weft yarn 7 to be supplied thereinafter by the weft winding guide member 27 is wound on the drum 20 at the frustoconical section (20*a*) side relative to the first hook section 31*a*.

In the 5th and 6th loom operational cycles, sequential twice weft pickings take place in the same manner as in the 1st and 2nd loom operational cycles, respectively.

FIGS. 11 to 18 illustrate another embodiment of the weft detaining device 6'' in accordance with the present invention, in which the weft detaining device is of the rotating drum type. In this embodiment, the same reference numerals and characters as in the embodiment of FIGS. 1 to 10 designate the corresponding parts and elements. While only one weft detaining device 6'' is shown and described, another similar weft detaining device is located parallel with the device 6'', though not shown, similar to in the embodiment of FIGS. 1 to 10.

In the weft retaining device 6'', a hollow shaft 51 is rotatably supported at its central section in the bearing section 12*a* by the ball bearing 13. The toothed pulley 15 is fixedly mounted on a rear section of the hollow shaft 51 by means of a key (no numeral). The toothed belt 16 connects the pulley 15 and a drive pulley (not shown) to rotate the hollow shaft 51 in timed relation to the operational cycle of the loom. The hollow shaft 51 rotates two times per each operational cycle of the loom.

A support ring 52 having a slit (not shown) is mounted on a front portion of the hollow shaft 51, and is fixed in position by a fastening member 53. A drum 54 is fixed on an annular flange section 52*a* of the support ring 52 in such a manner that a flange section 55 of the drum 54 is positioned between the front surface of the flange section 52*a* and a base plate 56, and is fixed thereto as a single member by bolts 57. The drum 54 is provided at its peripheral surface with a first frustoconical section 54*a*, tapered in the direction from the rear end section R to the front end section F of the drum 54. The frustoconical section 54*a* terminates at a first small diameter section $S_1$. A second frustoconical section 54*b* continues from the first diameter section $S_1$, tapering in the reverse direction to that of the first frustoconical section 54*a*, and terminates at a large diameter section L. A third frustoconical section 54*c* continues from the large diameter section L, tapering in the same direction as the first frustoconical section 54*a*, and terminates at a second small diameter section $S_2$, smaller than the first diameter section $S_1$. A cylindrical section 54*d* continues from the second small diameter section $S_2$ and extends to the front end section F of the drum 54. The cylindrical section 54*d* has a diameter smaller than that of $S_1$. In this instance, the diameter of the cylindrical section 54*d* is set so that the length of the weft yarn wound four times on the cylindrical section 54*d* corresponds to the weft length required for each weft picking.

Figure 12:
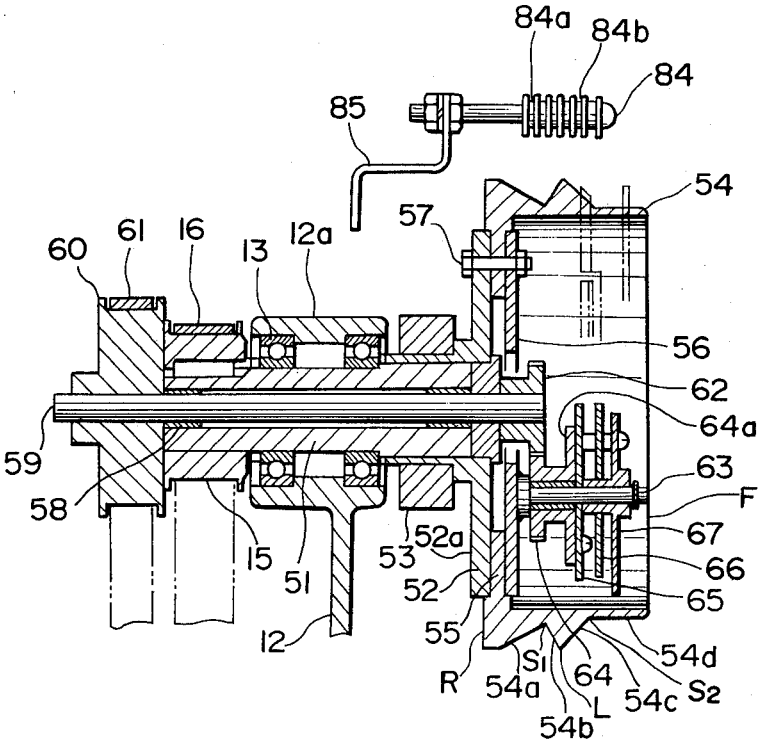
FIG. 12 is a vertical sectional view of the weft detaining device of FIG. 12.
Figure 13:
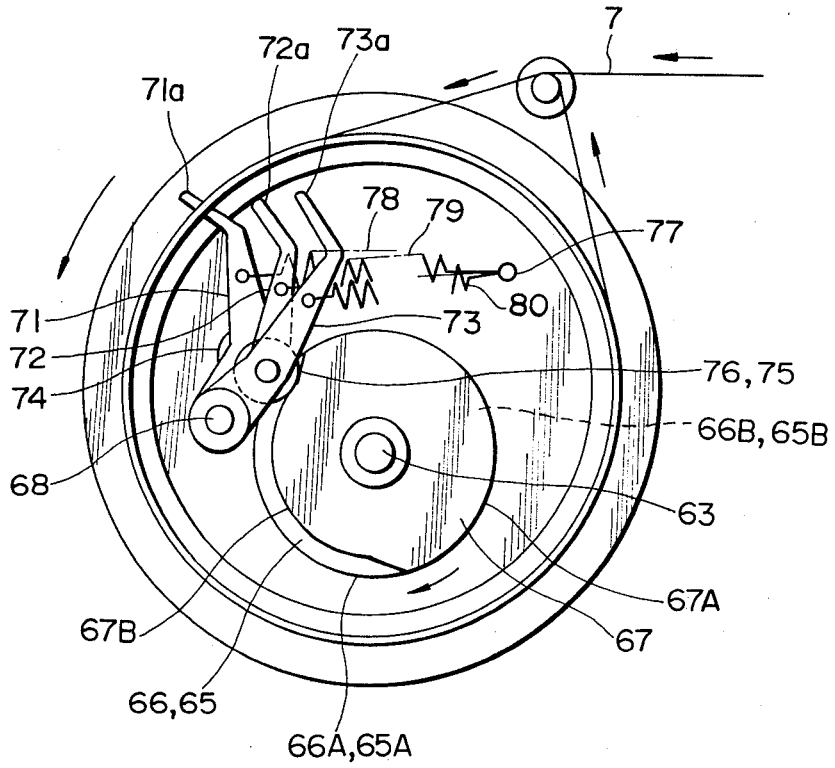
FIG. 13 is a side elevation of the weft detaining device of FIG. 12.

A cam operating shaft 59 is disposed within the hollow shaft 51 on bearings 58 so as to be rotatable relative to the hollow shaft 51. The cam operating shaft 59 is securely provided at its rear end section with a toothed pulley 60 which is rotated by a toothed belt 61 driven by a drive pulley (not shown) of the loom, so that the cam operating shaft 59 rotates $\frac{1}{4}$ times per each loom operational cycle. The front end section of the cam operating shaft 59 is located inside of the drum 54 and is securely provided with a gear 62 which is mounted on the shaft (59) front end section. The gear 62 engages a gear 64 which is rotatably mounted on a shaft 63 mounted on the base plate 56. The gear 64 is provided with a flange section 64*a* which is located spaced from and parallely with the gear 64. Three plate like cams 65, 66 and 67 are secured to the side surface of the flange section 64*a* so as to be parallel with the flange section 64*a*. The three cams 65, 66, 67 are parallel to and spaced from each other as shown in FIG. 12. The gear ratio between the gears 62 and 64 is 1:1, so that each of cams 65, 66, 67 rotates $\frac{1}{4}$ times, revolving around the gear 62, per each loom operational cycle.

First, second and third hook levers 71, 72 and 73 of the same shape are rotatably mounted at their end sections on a fixed shaft 68 which is mounted on the base plate 56. Cam rollers 74, 75 and 76 are rotatably attached to the central sections of the first, second and third hook levers 71, 72, 73, respectively. Springs 78, 79 and 80 are disposed between hook levers 71, 72, 73 and a pin 77 which is planted on the base plate 56, so that the first, second and third hook levers 71, 72, 73 are biased to urge the cam rollers 74, 75, 76 to contact the cams 65, 66, 67, respectively. The first, second and third hook levers 71, 72, 73 are formed with first, second and third hook sections 71*a*, 72*a* and 73*a* which are located to face holes 81, 82, 83, respectively. Through-holes 81, 82 are formed in the vicinity of the border between the third frustoconical section 54*c* and the cylindrical section 54*d*. Through-hole 83 is formed on the cylindrical section 54*d*. The hook sections 71*a*, 72*a*, 73*a* of the first, second and third hook levers 71, 72, 73 are constructed and arranged to project out of the drum 54 through the holes 81, 82, 83 when high lobe sections 65A, 66A, 67A of the cams 65, 66, 67 contact cam rollers 74, 75, 76, respectively, and to be withdrawn into the drum 54 when low lobe sections 65B, 66B, 67B of the cams 65, 66, 67 contact the cam rollers, respectively. It is preferable that each hook section 71*a*, 72*a* of the first and second hook levers 71, 72 is formed at its tip portion with a tapered or inclined surface which is generally parallel with the tapered surface of the drum third frustoconical section 54*c*, in order that the weft yarn 7 can well be separated when the hook section projects out of the drum through the hole of the drum.

A rod like guide 84 is fixed on the tip end of a stay 85 which is fixed to the bracket 12. The guide 84 is formed with at least two grooves 84*a* and 84*b*, and is positioned so that the axis thereof is parallel to that of the drum 54. The weft yarn 7 drawn from a yarn supply means or source such as a cone-shaped bobbin engages the groove 84*a* and then passes on to a groove formed at the drum first small diameter section $S_1$ between the first and second frustoconical sections 54*a*, 54*b*. Subsequently, the weft yarn 7 engages the guide groove 84*b* and passes on to the third frustoconical section 54*c* and on to the cylindrical section 54*d*, and thereafter is caught by at least one of the hook sections 71*a*, 72*a*, 73*a* and passed through the guide 4.

The manner of operation of the weft detaining device 6″ will be illustrated hereinafter. During the operation of the loom, the rotatable shaft 51 rotates two times per each loom operational cycle. Accordingly, the weft yarn 7 introduced through the groove 84*a* of the guide 84 is supplied on the drum first frustoconical section 54*a*, and is then wound on the groove between the adjacent frustoconical sections 54*a*, 54*b*. Thereafter, when contacted with the drum third frustoconical section 54*c* through the groove 84*b* of the guide 84, the weft yarn 7 slides along the slope of the frustoconical third section 54*c* by its own tension and moves to the cylindrical section 54*d*, pushing ahead the weft yarn wound forward thereof.

When the loom operational cycle reaches a timing immediately before the first time weft picking in the 1st loom operational cycle, the first, second and third hook sections 71*a*, 72*a*, 73*a* of the first, second and third hook levers 71, 72, 73 enter or are inserted into the holes 81, 82, 83 of the drum 54, respectively, so as to project outside of the outer surface of the drum 54. In this state, the weft yarn 7 is caught by the first hook section 71*a* and is then caught by the second hook section 72*a* after being wound four times around the drum 54 in the vicinity of the border between the third frustoconical and cylindrical sections 54*c*, 54*d*; the weft yarn 7 is further caught by the third hook section 73*a* after being wound four times around the drum cylindrical section 54*d*.

At the first time weft picking, the third hook section 73*a* is withdrawn from the hole 83 of the drum 54, so that the weft yarn 7 wound between the second and third hook sections 72*a*, 73*a* is drawn off to be picked or inserted into the warp shed under the influence of water-jet ejection through the nozzle 2, which ejection begins immediately before this withdrawal of the third hook section. When the amount of the weft yarn 7 wound between the second and third hook sections 72*a*, 73*a* becomes zero or nothing by the weft picking, the weft yarn 7 is caught by the second hook section 73*a* to complete the weft picking. Until the completion of this weft picking, the weft yarn 7 is wound about two times on the drum at the third frustoconical section (54*c*) side relative to the first hook section 71*a* (See FIG. 14).

At the second time weft picking in the 2nd loom operational cycle, the second hook section 72*a* is withdrawn from the hole 82 of the drum 54, so that the weft yarn 7 wound between the first and second hook sections 71*a*, 72*a* is drawn off to be picked or inserted into the warp shed, under the influence of water-jet ejection through the nozzle 2 which ejection begins immediately before the withdrawal of the second hook section 72*a*. When the amount of the weft yarn 7 wound between the first and second hook sections 71*a*, 72*a* becomes zero or nothing by this weft picking, the weft yarn 7 is caught by the first hook section 71*a* to complete the weft picking. Until this time, the weft yarn 7 is wound about four times on the drum 54 at the third frustoconical section (54*c*) side relative to the first hook section 71*a* (See FIG. 15).

Figure 16:
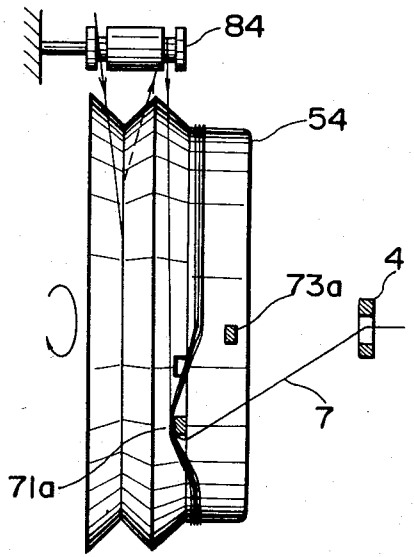
FIGS. 14 to 18 are side views of a drum of the weft detaining device of FIG. 11 at various operational timings, illustrating the operation of the weft detaining device.
Figure 15:
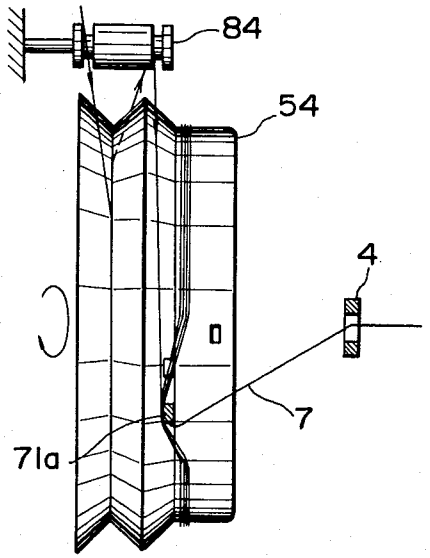
Figure 14:
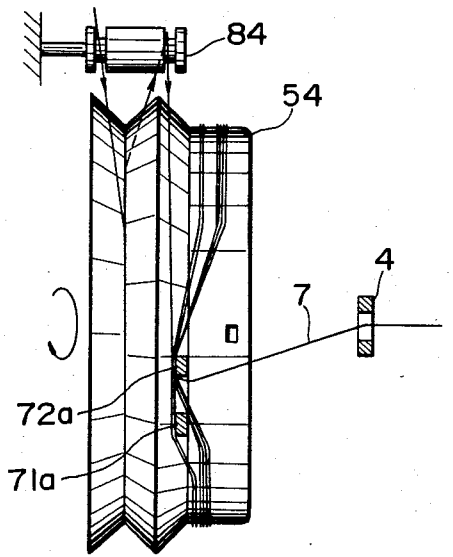

Thereafter, first the third hook section 73*a* is again inserted into the hole 83 of the drum 54 to be projected outside of the drum outer surface (See FIG. 16). Subsequently, the first hook section 31*a* is withdrawn from the hole 83 of the drum 54, so that the weft yarn 7 which has been wound about four times around the third frustoconical section 54*c* slides down along the slope of the third frustoconical section 54*c* and moves onto the cylindrical section 54*d*, and is caught by the third hook section 73*a*. Almost simultaneously with the withdrawal of the first hook section 71*a*, the second hook section 72*a* is inserted into the hole 82 of the drum 54 to be projected outside of the drum outer surface so as to detain the weft yarn 7 wound four times between the second hook section 72*a* and the third hook section 73*a* (See FIG. 17). Accordingly, the weft yarn 7 to be supplied hereinafter is wound around the drum 54 at the third frustoconical section (54*c*) side relative to the second hook section 72*a*.

In the 3rd and 4th loom operational cycles, a weft yarn (not shown) detained by another weft detaining device (not shown) is inserted into the warp shed through another weft inserting nozzle (not shown), in which sequential twice weft pickings take place. In the weft detaining device 6'', the weft yarn 7 is wound about four times on the drum 54 at the third frustoconical section (54*c*) side relative to the second hook section 72*a* until the weft picking in the 4th loom operational cycle is completed.

Figure 18:
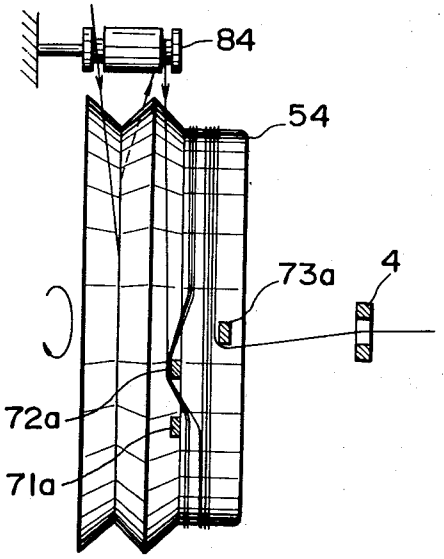
Figure 17:
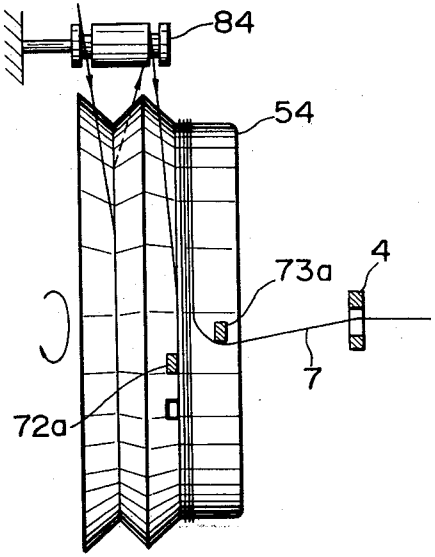

Then, the first hook section 71*a* is projected into the hole 81 of the drum 54 to be projected outside of the drum outer surface so as to detain the weft yarn 7 wound four times between the first hook section 71*a* and the second hook section 72*a* (See FIG. 18). Accordingly, the weft yarn 7 to be supplied thereafter is wound on the drum 54 at the third frustoconical section (54*c*) side relative to the first hook section 71*a*.

In the 5th and 6th loom operational cycles, sequential twice weft pickings take place in the same manner as in the 1st and 2nd loom operational cycles, respectively.

It will be understood that the third hook section 33*a*, 73*a* in the above-discussed embodiments may be replaced with an annular brush which is disposed around and in contact with the outer peripheral surface of the drum cylindrical section 20*b*, 54*d* in such a manner as to be positioned along the cylindrical section (20*b*) periphery passing through location of the hole 37, 83 for the third hook section 33*a*, 73*a*, in order to provide resistance to the weft yarn 7 to be drawn off. Otherwise, an annular resistance-providing member is directly disposed on and along the location of the above-mentioned annular brush, in place of the third hook sections 33*a*, 73*a*.

While only water-jet looms have been shown and described, it will be understood that the principle of the present invention is applicable to air-jet loom.

What is claimed is:

1. A weft detaining device of a shuttleless loom of the type wherein first and second times weft pickings take place in sequential first and second operational cycles, respectively, of the loom, and weft picking is disabled in succeeding third and fourth operational cycles of the loom, said weft detaining device comprising:

a drum on which a weft yarn is wound prior to its introduction to a weft inserting means, said drum being formed with a frustoconical section tapered toward the weft inserting means side, and a cylindrical section integral with said frustoconical section and located nearer to said weft inserting means than to said frustoconical section, the weft yarn from weft supply means being introduced through said drum to said weft inserting means;

a first catching member for catching the weft yarn on said drum in the vicinity of the border between said frustoconical and cylindrical sections for at least a period of weft pickings, in timed relation to the operational cycle of the loom;

a second catching member for catching the weft yarn on said drum for at least a period of the first time weft picking and releasing its catching action to the weft yarn for at least a period of the second time weft picking, in timed relation to the loom operational cycle, the weft yarn of a predetermined length required for each weft picking being detained on said drum between said first and second catching members; and a third catching member for catching the weft yarn on said cylindrical section for at least a period of the third and fourth loom operational cycles where the detaining of the weft yarn for the succeeding weft pickings is completed, the weft yarn of the predetermined length being detained on said drum between said second and third catching members.

2. A weft detaining device as claimed in claim 1, wherein said first catching member releases its catching action to the weft yarn for at least a period of the third loom operational cycle.

3. A weft detaining device as claimed in claim 1, wherein said second catching member catches the weft yarn on said drum for at least a period of third and fourth loom operational cycles.

4. A weft detaining device as claimed in claim 1, wherein said third catching member releases its catching action to the weft yarn for at least a period of the first and second times weft pickings.

5. A weft detaining device as claimed in claim 1, further comprising means for supporting said drum in a stationary state.

6. A weft detaining device as claimed in claim 5, wherein said stationary state supporting means includes a rotatable shaft on which said drum is rotatably mounted, said rotatable shaft rotating in timed relation to the loom operational cycle, and means for maintaining said drum in the stationary state.

7. A weft detaining device as claimed in claim 6, wherein said stationary state supporting means includes a first magnet disposed inside of said drum, and a second magnet disposed outside of and spaced apart from said drum, said second magnet being located opposite to said first magnet to generate magnetic attraction therebetween.

8. A weft detaining device as claimed in claim 7, further comprising a weft winding guide member securely mounted on said rotatable shaft and located near the peripheral surface of said drum frustoconical section to guide the weft yarn from said weft supply means onto said drum frustoconical section so as to wind the weft yarn around said drum.

9. A weft detaining device as claimed in claim 8, wherein said first, second, third weft catching members are first, second, third hook levers, respectively which are positioned outside of said drum and formed respectively with first, second, and third hook sections, said first, second, and third hook levers being swingably mounted on a fixed shaft so as to move toward and away from said drum, in which said drum is formed with first, second and third holes into which said first, second and third hook sections are insertable, respectively, for catching the weft yarn on said drum, said first and second holes being located in the vicinity of the border between said frustoconical and cylindrical sections and slightly spaced from each other, said third hole being located on said cylindrical section.

10. A weft detaining device as claimed in claim 9, further comprising first, second and third rotatable cams which rotate in timed relation to the loom operational cycle and move said first, second and third hook levers, respectively, each rotatable cam having a high lobe section by which the hook section of each hook lever is inserted into the corresponding hole of said drum, and a low lobe section by which the hook section of each hook lever is withdrawn from the corresponding hole of said drum.

11. A weft detaining device as claimed in claim 10, wherein said drum cylindrical section has such a diameter that the length of the weft yarn wound about four times thereon corresponds to a weft yarn length required for each weft picking, in which said rotatable shaft rotates two times per each loom operational cycle, and each rotatable cam rotates ¼ times per each loom operational cycle.

12. A weft detaining device as claimed in claim 1, further comprising means for rotatably supporting said drum.

13. A weft detaining device as claimed in claim 12, wherein said rotatably supporting means includes a hollow rotatable shaft on which said drum is securely mounted, said rotatable shaft being driven to rotate said drum in timed relation to the loom operational cycle.

14. A weft detaining device as claimed in claim 13, further comprising a weft guide generally in the shape of a cylindrical rod and having an annular guide groove, said weft guide being rotatably supported by a stationary stay member and located spaced from and near the peripheral surface of said drum, the weft yarn from said weft supply means being introduced through said weft guide onto the peripheral surface of said drum.

15. A weft detaining device as claimed in claim 13, wherein said first, second and third weft catching members are first, second and third hook levers, respectively, which are positioned inside of said drum and formed respectively with first, second and third hook sections, said first, second and third hook levers swingably mounted on a common shaft connected to said drum so as to move toward and away from the inner surface of said drum, said drum being formed with first, second and third holes into which said first, second and third hook sections are insertable, respectively, to project outside of the peripheral surface of said drum to catch the weft yarn wound on said drum, said first and second holes being located in the vicinity of the border between said frustoconical and cylindrical sections and slightly spaced from each other, said third hole being located on said cylindrical section.

16. A weft detaining device as claimed in claim 15, further comprising first, second and third rotatable cams which are rotatably mounted on a common shaft connected to said drum and rotatable in timed relation to the loom operational cycle so as to move said first, second and third hook levers, respectively, each rotatable cam having a high lobe section by which the hook section of each hook lever is inserted into the corresponding hole of said drum, and a low lobe section by which the hook section of each hook lever is withdrawn from the corresponding hole of said drum.

17. A weft detaining device as claimed in claim 16, further comprising means for driving said rotatable cams, said means including a cam-drive shaft rotatably disposed within said hollow rotatable shaft, said cam-drive shaft extending to the inside of said drum and being rotatable in timed relation to the loom operational cycle, a first gear securely mounted on said cam-drive shaft and disposed inside of said drum, and a second gear engaged with said first gear and rotatably mounted on said common shaft on which said rotatable cams are mounted, said first, second and third rotatable cams being securely connected to said second gear.

18. A weft detaining device as claimed in claim 17, wherein said drum cylindrical section has such a diameter that the length of the weft yarn wound about four times thereon corresponds to a weft yarn length required for each weft picking, in which said rotatable shaft rotates two times per each loom operational cycle, said cam-drive shaft rotates ¼ times per each loom operational cycle, and the gear ratio between said first and second gears is 1:1 so that each rotatable cam rotates ¼ times per each loom operational cycle.

* * * * *

UNITED STATES PATENT AND TRADEMARK OFFICE

CERTIFICATE OF CORRECTION

PATENT NO. : 4,397,340

DATED : August 9, 1983

INVENTOR(S) : H. Umezawa, T. Ogasawara, T. Honya

It is certified that error appears in the above-identified patent and that said Letters Patent are hereby corrected as shown below:

Column 10, line 64, delete "in which said drum is" and insert therefor -- said drum being --.

Signed and Sealed this

First Day of November 1983

[SEAL]

*Attest:*

GERALD J. MOSSINGHOFF

*Attesting Officer*

*Commissioner of Patents and Trademarks*